US005774090A

United States Patent [19]

Marcy et al.

[11] Patent Number: 5,774,090

[45] Date of Patent: Jun. 30, 1998

[54] METHOD AND DEVICE TO BROADEN THE RADIATION PATTERN OF AN ACTIVE ANTENNA

[75] Inventors: Jean-Pierre Marcy, Bourg la Reine; Joseph Roger, Bures S/Yvette, both of France

[73] Assignee: Thomson-CSF, Paris, France

[21] Appl. No.: 529,612

[22] Filed: Sep. 18, 1995

[30] Foreign Application Priority Data

Sep. 23, 1994 [FR] France ..... 94 11377

[51] Int. Cl.[6] ..... H01Q 3/22; H01Q 3/24; H01Q 3/26

[52] U.S. Cl. ..... 342/372; 342/157

[58] Field of Search ..... 342/372, 373, 342/81, 157, 154

[56] References Cited

U.S. PATENT DOCUMENTS

| | | | |
|---|---|---|---|
| 3,509,577 | 4/1970 | Kinsey . | |
| 3,778,824 | 12/1973 | Roger . | |
| 3,797,020 | 3/1974 | Roger et al. . | |
| 5,008,677 | 4/1991 | Trigon et al. . | |
| 5,034,752 | 7/1991 | Pourailly et al. . | |
| 5,036,336 | 7/1991 | Bouko et al. . | |
| 5,038,149 | 8/1991 | Aubry et al. . | |
| 5,049,893 | 9/1991 | Coppier et al. . | |
| 5,063,363 | 11/1991 | Coppier et al. . | |
| 5,138,324 | 8/1992 | Aubry et al. . | |
| 5,170,174 | 12/1992 | Caer et al. . | |
| 5,172,128 | 12/1992 | Bouko et al. . | |
| 5,396,256 | 3/1995 | Chiba et al. | 342/372 |
| 5,414,433 | 5/1995 | Chang | 342/375 |
| 5,424,748 | 6/1995 | Pourailly et al. . | |

OTHER PUBLICATIONS

IEEE Transactios on Antennas and Propagation, vol. 36, No. 3, "Low Sidelobe Electronically Scanned Antenna Using Identical Transmit/Receive Modules", Dufort, Mar. 1988, New York, USA, pp. 349–356.

Microwave Journal, vol. 35, No. 1, "Integrated Multiple Beam Microstrop Arrays", Hall et al., Jan. 1992, Dedham, USA, pp. 103–104, 106, 111–112, 114.

Proceedings of the IEEE, vol. 80, No. 1, "Antenna Array Architecture", Mailloux, Jan. 1992, New York, USA, pp. 163–172.

*Primary Examiner*—Theodore M. Blum

*Attorney, Agent, or Firm*—Oblon, Spivak, McClelland, Maier & Neustadt, P.C.

[57] ABSTRACT

The disclosed broadening method consists in dividing the radar antenna into n groups of columns of active modules, applying, at transmission, a different linear phase law to each group and, at reception, forming $n^2$ simultaneous beams, each having the nominal angular width of the complete antenna, and in shifting these beams as a whole to cover the angular domain in which the energy has been radiated at emission.

3 Claims, 1 Drawing Sheet

METHOD AND DEVICE TO BROADEN THE RADIATION PATTERN OF AN ACTIVE ANTENNA

BACKGROUND OF THE INVENTION

An object of the present invention is a method and a device to broaden the radiation pattern of an active antenna.

Active antennas are being ever increasingly used in radars because they provide many advantages as compared with standard electronic scanning antennas. Among these advantages, we may note in particular the use of solid-state components, improved efficiency and the slow attrition of their characteristics.

Another advantage of active antennas is the possibility of achieving the combination, by computation, of the signals received from the elementary sources of the antenna to obtain the equivalent of a multitude of antenna patterns simultaneously. This is a technique known as "beam formation by computation". It requires that the space covered by this set of beams should be illuminated by the transmission of the radar.

However, it is not possible to substantially broaden the transmission beam of these active antennas without downgrading their characteristics. A broadened beam is often necessary in watch mode, especially in order to ensure a period of measurement sufficient to obtain favorable conditions in Doppler measurements (for the elimination of the fixed echoes).

The standard method of beam broadening by the use of a quadratic phase law is limited to a broadening by a factor of 2. This is because of the relationship of uniform illumination dictated by the power amplifiers of the radar transmitters, which very generally work in class C mode, in order to obtain high output.

It is possible to envisage the "extinguishing" of a part of the antenna at transmission, but such an approach is incompatible with the obtaining of high factors of beam broadening for, in this case, the product (transmission power by gain) collapses and, consequently, so does the range of the radar.

SUMMARY OF THE INVENTION

An object of the present invention is a method making it possible to broaden the radiation pattern of an active radar antenna in such a way the broadening factor may be substantially greater than 2, without in any way diminishing the range of the radar, and without modifying the working conditions of the power amplifiers of this radar, while at the same time obtaining an appropriate radiation pattern.

An object of the invention is also a radar implementing the method of the invention.

According to the invention, there is proposed a method for broadening the radiation pattern of an active antenna comprising k.n columns or rows of active modules, k being an integer greater than or equal to 1, wherein said method consists in dividing the antenna into n adjacent parts, applying, at transmission, a signal with a determined phase law to each of the n parts, at least a part of this signal being preferably linear and forming, at reception, $n^2$ simultaneous beams, each having an angular length equal to n times the angular width of the nominal beam of the complete antenna, the relative phase shifts of these beams each following a different law, at least a part of these laws being preferably linear, this set of beams being shifted as a whole to cover all of the angular domain desired.

According to the invention, there is also proposed a radar comprising a transmitter, a receiver and an antenna comprising k.n columns or rows of active modules and phase-shifters, wherein the transmitter comprises circuits which, for each adjacent group of n columns of active modules, apply different control signals to the corresponding phase-shifters, the receiver being connected to a beam formation matrix that works by computation or by analog means.

BRIEF DESCRIPTION OF THE DRAWING

The invention will be understood more clearly from the following detailed description of a preferred embodiment, taken as a non-restrictive example and from illustrated by the appended drawing, wherein.

MORE DETAILED DESCRIPTION

The invention is described here below with reference to the broadening in relative bearing of the pattern of an antenna but it is clear that the broadening can also be achieved in elevation instead of in relative bearing, or in addition to the broadening in relative bearing.

Figure 1:
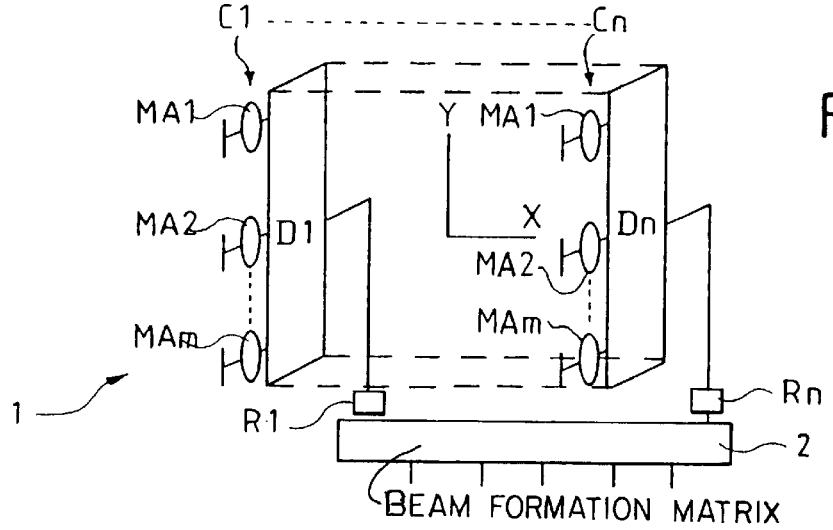
FIG. 1 shows a simplified drawing of a part of a radar according to the invention.

FIG. 1 gives a schematic view of an active antenna 1 comprising n*m active modules MA positioned in a Cartesian array of n columns C1 to Cn each comprising m modules referenced, in each column, MA1 to MAm. The modules MA of each column are connected to a corresponding column distributor, respectively D1 to Dn. Each of these distributors is connected by a receiver element, respectively R1 to Rn, to a matrix 2 for the formation of beams, in relative bearing for example. This matrix 2 is either an analog beam formation matrix or a beam formation matrix working by computation. The matrix 2 is connected to a radar transmitter (not shown).

Figure 2:
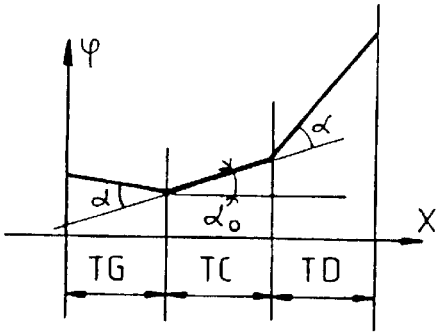
FIG. 2 is a graph pertaining to the phase shifts applied in transmission to the different parts of the antenna of FIG. 1, when this antenna is divided into three parts.

FIG. 2 shows an exemplary graph of the phases of the signals applied, in transmission, to the antenna 1. For this example, the number n of columns is a multiple of 3. The columns are considered in order from one side to the other. The antenna is divided into three adjacent thirds, each comprising the same number of columns. These three thirds are referenced LT (left-hand third), CT (central third) and RT (right-hand third) in FIG. 2. Each of these thirds corresponds to a phase law varying linearly with the abscissa of the column considered, but the slope of these linear laws varies from one third to another. Each antenna third thus generates a directional beam whose aiming direction is defined by the slope of its phase law.

Figure 3:
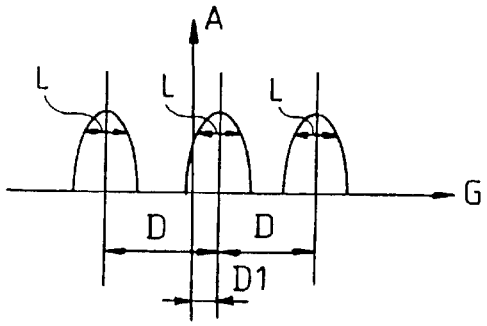
FIG. 3 shows the pattern of the transmission beams, as a function of the relative bearing, of the antenna of the invention, to which the phase shifts according to FIG. 2 are applied.

FIG. 3 is a representation, in Cartesian coordinates, of the pattern, as a function of relative bearing, of the beams produced by the antenna supplied in the manner described here above with reference to FIG. 2. Three lobes of substantially identical beams are obtained, each having an angular width L (at −3 dB) equal to three times that of the lobe of the nominal beam of the complete standard active antenna. In this FIG. 3, D denotes the distance between the axes of the three lobes, D being proportional to the angle (see FIG. 2) and D1 denotes the distance between the axis of the central lobe and the axis A of the antenna D1, D1 being proportional to $\alpha D$ (see FIG. 2).

The slopes of the three phase laws should have a difference between one another that is sufficient for the three beams given to be well separated and for them not to interfere with one another. From a practical viewpoint, it may be estimated that this condition is achieved when the separation between the axes of the beams exceeds three times the width at 3 dB of these beams. Thus, the three beams are sufficiently distant from one another to avoid creating mutual interference while at the same time having a broadened transmission pattern (with a total width equal to nine times the width of the nominal beam of the antenna).

It is advantageous, without this being an obligation, that the distance between the axis of the left lobe and the axis of the central lobe should be equal to the distance between the axis of the central lobe and the axis of the right lobe. This means that the difference between the slopes of the phase laws should be the same between the left-hand third and central third as it is between the central third and the right-hand third (angle $\alpha$ in FIG. 2).

To illuminate the entire space in which the radar is supposed to work, it is enough to keep the angle $\alpha$ constant. This dictates the spacing between the three lobes and makes it necessary to carry out the azimuthal scanning of the desired space by means of the three beams, by bringing about the variation of the angle $\alpha$ (FIG. 2) which defines the aiming of the central beam.

Figure 4:
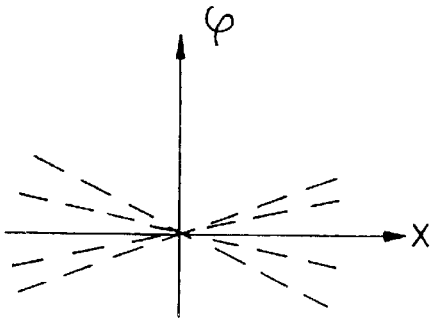
FIG. 4 is a graph pertaining to the phase laws applied at reception to the antenna of the invention.

At reception, nine beams are formed simultaneously, each of them having a width substantially equal to the nominal angular width of the complete antenna. This is done by means of the matrix 2 of FIG. 1 which simultaneously implements nine different phase laws, preferably linear, that enable the covering of the angular domain (in relative bearing in this case) in which the transmission energy has been radiated. To simplify the drawing, FIG. 4 shows only four of these phase laws.

Figure 5:
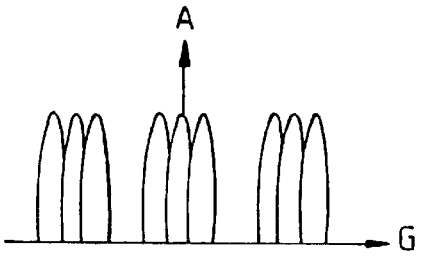
FIG. 5 shows the pattern of the reception beams, as a function of the relative bearing, of the antenna of the invention.

As can be seen in FIG. 5, the phase laws are chosen so as to obtain, for example, three groups of three adjacent beams, each group receiving one of the broadened lobes in which the transmission is done. In the watching state, the beams thus formed (nine in the present case) are shifted as a whole in order to cover the angular domain being monitored without "gaps" (in elevation and/or in relative bearing). This shifting is achieved by bringing about the simultaneous varying of the phases of the groups of beams.

In general, when an antenna comprising k.n columns (or rows) is divided into n equal adjacent groups, there is obtained, according to the invention, a broadening of the width of the original beam by $n^2$. In practice, this broadening may be by 1, 4, 9, 16, 25 . . .

Naturally, the method of the invention may be associated with the standard beam broadening methods.

What is claimed is:

1. A method for broadening the radiation pattern of an active antenna comprising k.n columns or rows of active modules, k being an integer greater than or equal to 1, wherein said method consists in dividing the antenna into n adjacent parts, applying, at transmission, a signal with a determined phase law to each of the n parts, and forming, at reception, $n^2$ simultaneous beams, each having an angular length equal to n times the angular width of the nominal beam of the complete antenna, the relative phase shifts of these beams each following a different law, this set of beams being shifted as a whole to cover all of the angular domain desired.

2. A method according to claim 1 wherein, at transmission, at least one of said n adjacent parts has an applied signal with a determined phase law that is linear.

3. A method according to claim 1 wherein, at reception, at least one of the relative phase shifts of said $n^2$ simultaneous beams follows a law that is linear.

* * * * *